United States Patent [19]

Long et al.

[11] 4,269,094

[45] May 26, 1981

[54] DEVICE FOR PUNCHING HOLES IN TUBING

[75] Inventors: Kelso M. Long; Leonard Pharr, both of Ringgold; Earl J. Pharr, Rossville, all of Ga.

[73] Assignee: Burner Systems International, Inc., Rossville, Ga.

[21] Appl. No.: 76,046

[22] Filed: Sep. 17, 1979

Related U.S. Application Data

[63] Continuation-in-part of Ser. No. 862,472, Dec. 20, 1977, abandoned.

[51] Int. Cl.[3] ..... B26D 5/24; B21D 28/28

[52] U.S. Cl. ..... 83/188; 83/257; 83/277; 83/278

[58] Field of Search ..... 83/188, 257, 277, 278, 83/222

[56] References Cited

U.S. PATENT DOCUMENTS

| | | | |
|---|---|---|---|
| 1,250,028 | 12/1917 | Schadow | 83/277 |
| 1,566,082 | 12/1925 | Dugins | 83/257 |
| 2,404,901 | 7/1947 | Cibs | 83/188 |
| 2,829,983 | 4/1958 | De Gain | 83/188 |
| 3,086,571 | 4/1963 | Cooper | 83/257 |
| 3,171,312 | 3/1965 | Fuchs et al. | 83/277 |
| 3,698,274 | 10/1972 | Coulon et al. | 83/188 |
| 3,771,400 | 11/1973 | Schaefer | 83/356 |

*Primary Examiner*—Donald R. Schran

*Attorney, Agent, or Firm*—David H. Semmes

[57] ABSTRACT

A punching apparatus, particularly a device for longitudinally advancing, while punching, a series of longitudinally aligned ports in cylindrical tubing of the type used in gas burners. The apparatus is distinguished by its employment of a single drive system for advancing and punching, together with adjustments for varying the height of the tubing, the depth of the punched port, and the longitudinal spacing between ports.

8 Claims, 9 Drawing Figures

DEVICE FOR PUNCHING HOLES IN TUBING

CROSS-REFERENCE TO RELATED APPLICATIONS

A continuation-in-part of applicants' earlier application Ser. No. 862,472, (now abandoned) filed Dec. 20, 1977 and entitled "Porting Apparatus for Punching Holes in Tubing". The present application defines the identical invention described in the parent application (being examined in Group Art Unit 323) and includes additional FIGS. 6–9, further illustrating the mode of operation.

BACKGROUND OF THE INVENTION

1. Field of the Invention

Gas burner systems, particularly means for punching holes in cylindrical tubing of the type used in gas burners.

2. Description of the Prior Art

PLOST U.S. Pat. No. 1,054,143,
PEARNE U.S. Pat. No. 1,305,972,
SMITH U.S. Pat. No. 2,296,483,
REID U.S. Pat. No. 3,094,158,
MUNSCHAUER U.S. Pat. No. 3,099,180,
KIDD U.S. Pat. No. 3,231,099,
SERAVIN U.S. Pat. No. 3,266,356,
BRANSON U.S. Pat. No. 3,540,258,
BROWN U.S. Pat. No. 3,678,718,
DAVIS U.S. Pat. No. 3,738,209,
FOULKS U.S. Pat. No. 3,815,399.

SUMMARY OF THE INVENTION

A porting apparatus for punching holes in gas burner tubing and the like, including a stationary punch arbor having a reciprocally actuated vertical punch and tube engaging collar, a tube arbor longitudinally reciprocable with respect to said punch arbor, so as to engage an end of a tubing being punched and a chain drive means linked to said punch such that the chain drive is advanced a single increment, as the punch arbor is pressed or punched vertically downwardly.

DESCRIPTION OF PREFERRED EMBODIMENT

Figure 1:
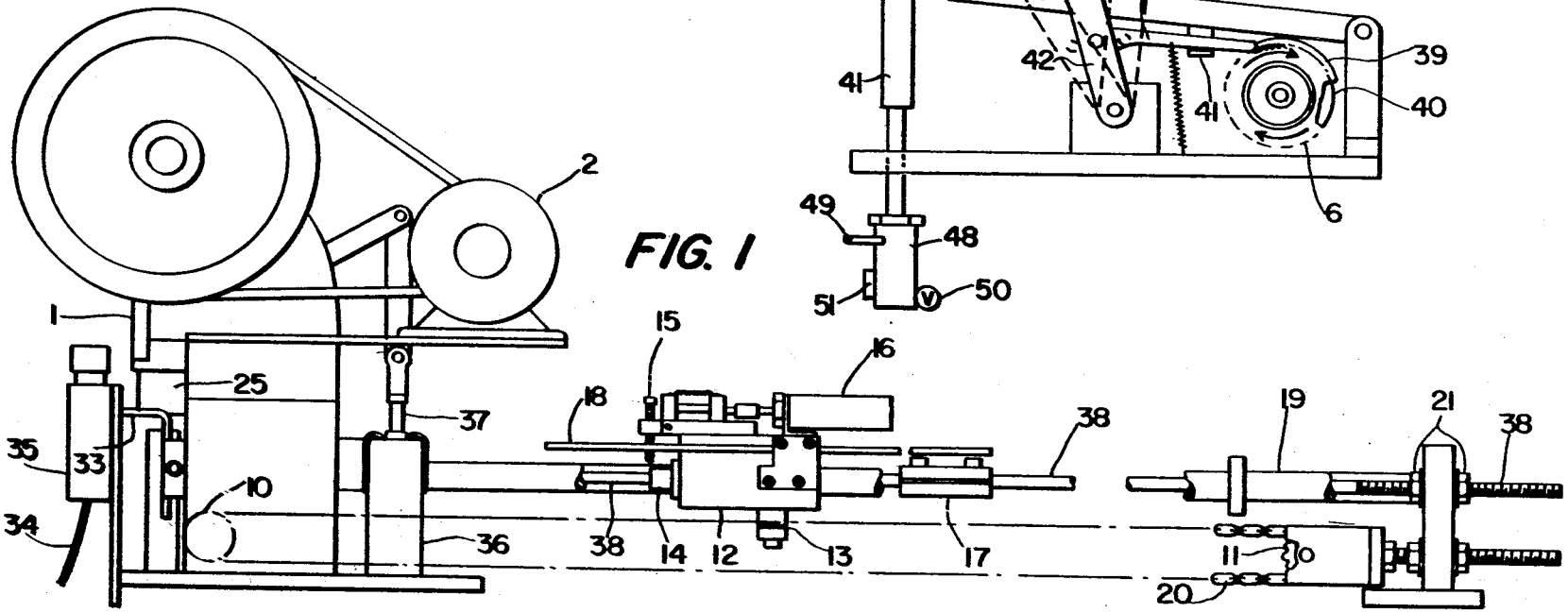
FIG. 1 is a side elevational view, partially in fragmentary section, showing a vertical punch reciprocally actuated at one end, and a tube arbor longitudinally movably positioned with respect to the punch arbor.
Figure 2:
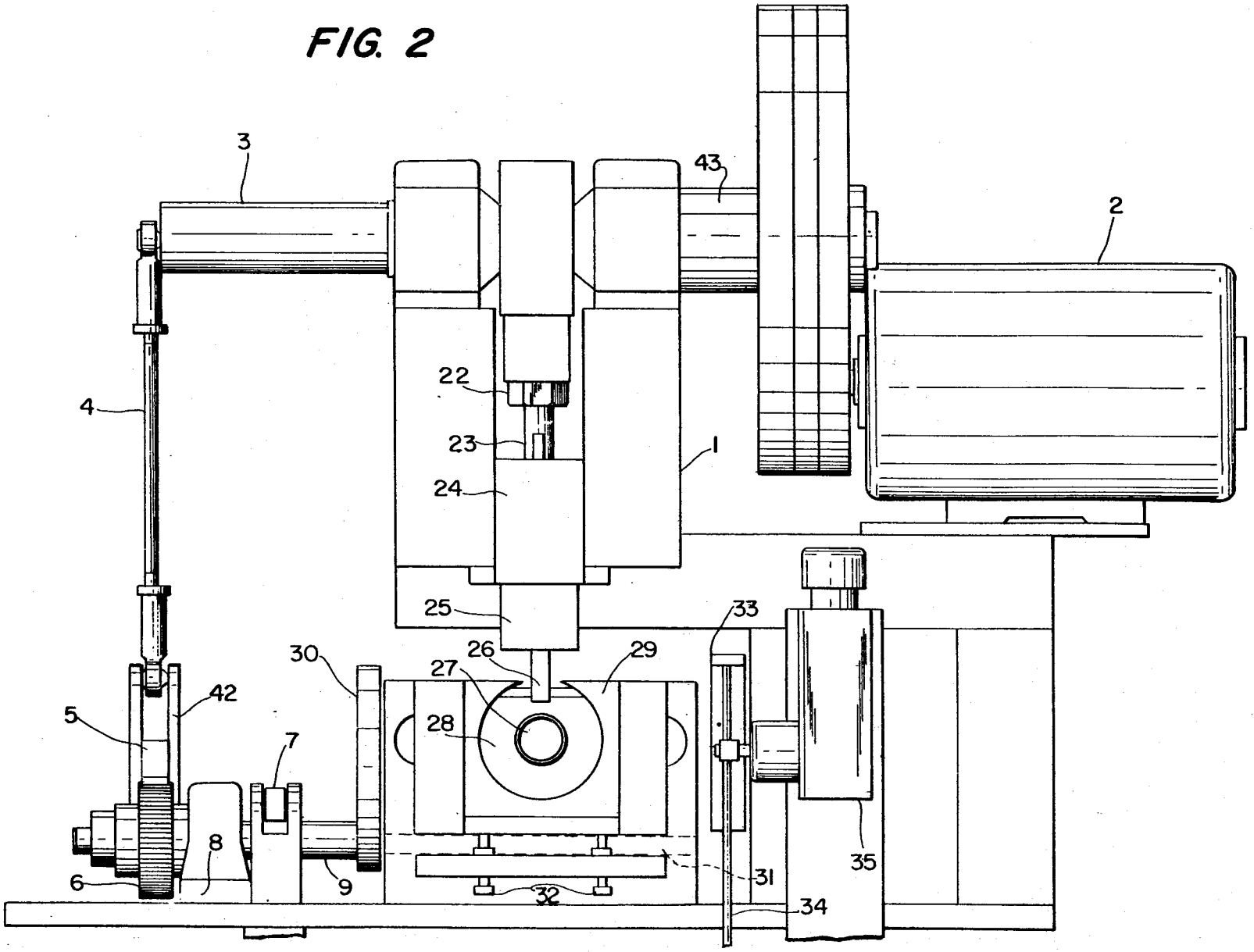
FIG. 2 is an end elevation of the punch arbor, showing the vertical punch reciprocally positioned with respect to the tube collar.
Figure 5:
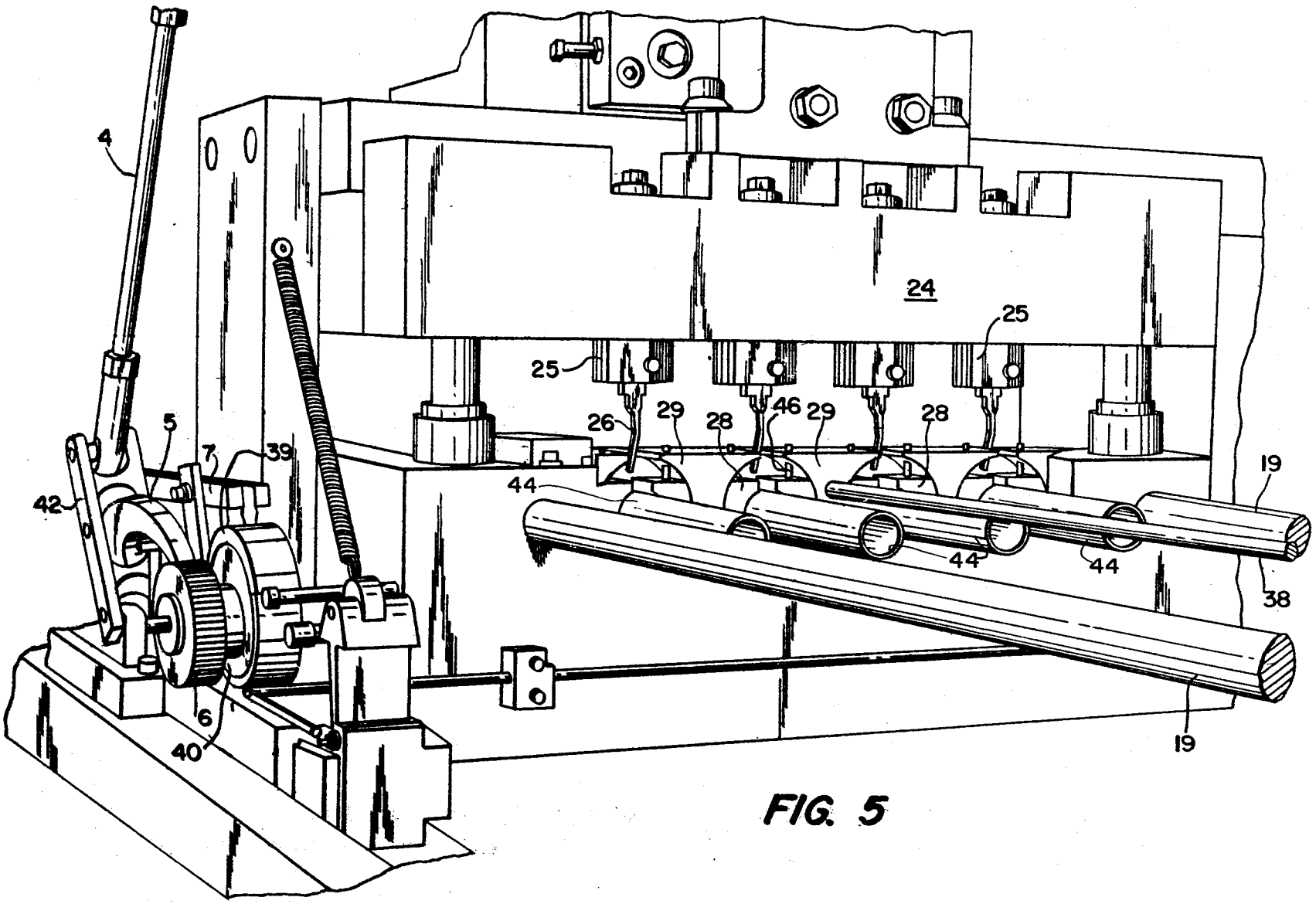
FIG. 5 is an enlarged, fragmentary perspective, showing the side-by-side array of four punches and respective tube engaging collars in the punch arbor.

As illustrated in FIGS. 1, 2 and 5, a tube 44 to be punched is placed through tube collar 28 passed over punch arbor 27, then at its other end this tube is placed over tube arbor 14 and locked into position by tube holding pin 15. Tube collar 28 is held within holder 29 by means of set screw 46. The tube holding pin 15 is activated by air cylinder 16, while synchronously activating air cylinder brake 41, so as to move brake arm 7 into position for brake 39 and ratchet arm 5.

As illustrated in FIG. 2, microswitch arm 34 is positioned to activate the microswitch 35 to complete the circuit through electric solenoid 36, tripping the clutch by movement of clutch trip arm 37 on press head 1 and thus starting the vertical reciprocatory movement of press ram 24, which holds punch 26 of varying size and configuration.

Figure 3:
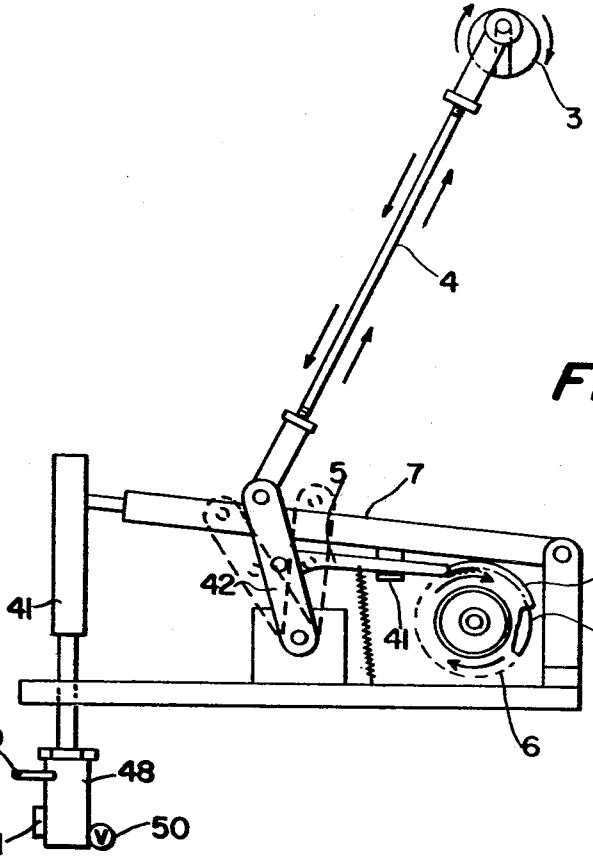
FIG. 3 is a side elevation of the linkage between the press ram crank shaft and the drive sprocket for advancing the drive chain.

As illustrated in FIG. 3, connector shaft 4 is activated by journal shaft 3 extending from crankshaft 43 of press head 1. Connecting shaft 4 is locked eccentrically in a "T" slot on journal shaft 3 so as to give a predetermined movement of connector shaft 4. This eccentric movement of connector shaft 4 pushes feed idler arm 42 and attached ratchet arm 5 into notches or teeth on ratchet gear 6.

Figure 4:
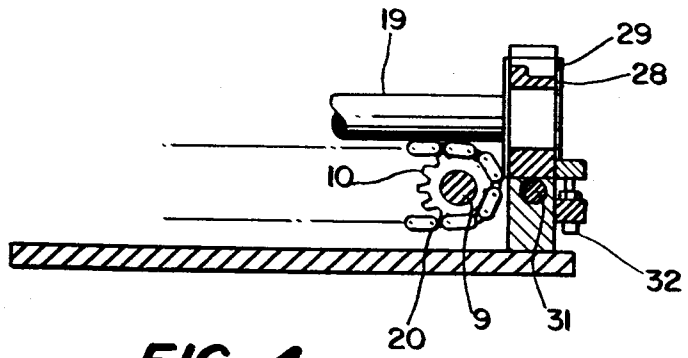
FIG. 4 is a fragementary elevation, partially in section, showing the cam and set screw vertical adjusting means for the tube engaging collar.

As illustrated in FIGS. 2 and 4, circular movement of ratchet gear 6 is transferred through ratchet drive shaft 9 to sprocket drive gear 10. Sprocket chain 20 encircling gears 10 and 11 is connected to tube holder assembly 12 by means of assembly fastener 13.

Figure 7:
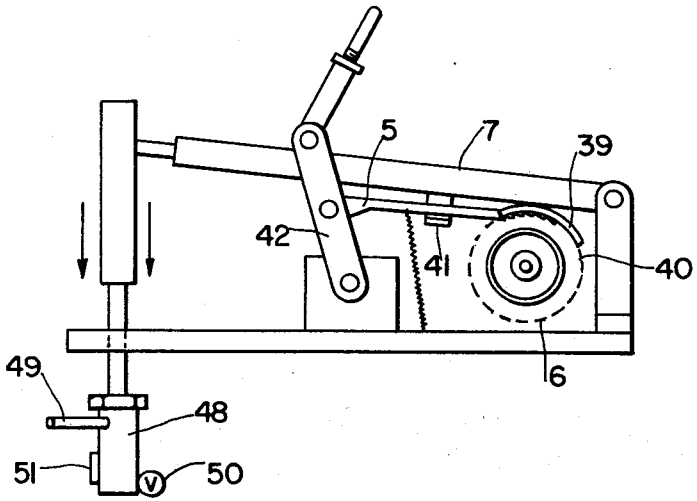
FIG. 7 is a fragmentary side elevation, along the lines of FIG. 3, and showing the air cylinder depressing contact area 5, so as to urge brake arm 39 against brake hub 40.
Figure 8:
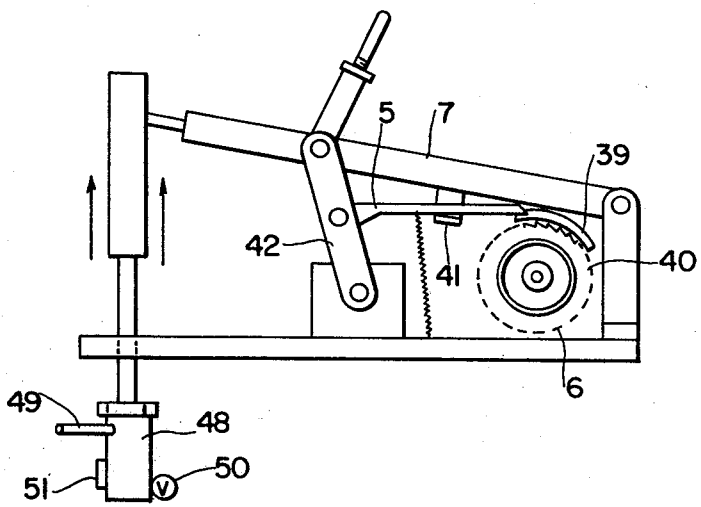
FIG. 8 is a fragmentary elevation, along the lines of FIGS. 3 and 7, illustrating the air cylinder raising brake arm 7, so as to disengage brake arm 39.

Since press head 1 and sprocket chain 20 will be moving at a very rapid pace, loose motion is controlled by sprocket idler gear 11, as well as brake 39 actuated manually by suitable air cylinder 48, having conventional air hose 49 feeding system, a conventional bleed off valve 50 and manual control 51 or the like to engage brake hub 40, as illustrated in FIGS. 7 and FIG. 8. This braking action provides a positive limitation for each longitudinal advance of the chain drive, so as to eliminate over advancing of the chain drive as a result of momentum. Using this braking control in the single barrel mode, approximately 500 punching strokes of the punch per minute have been achieved. In the multi-barrel mode, as illustrated in FIG. 5, approximately 200 punching strokes per minute have been achieved.

Figure 9:
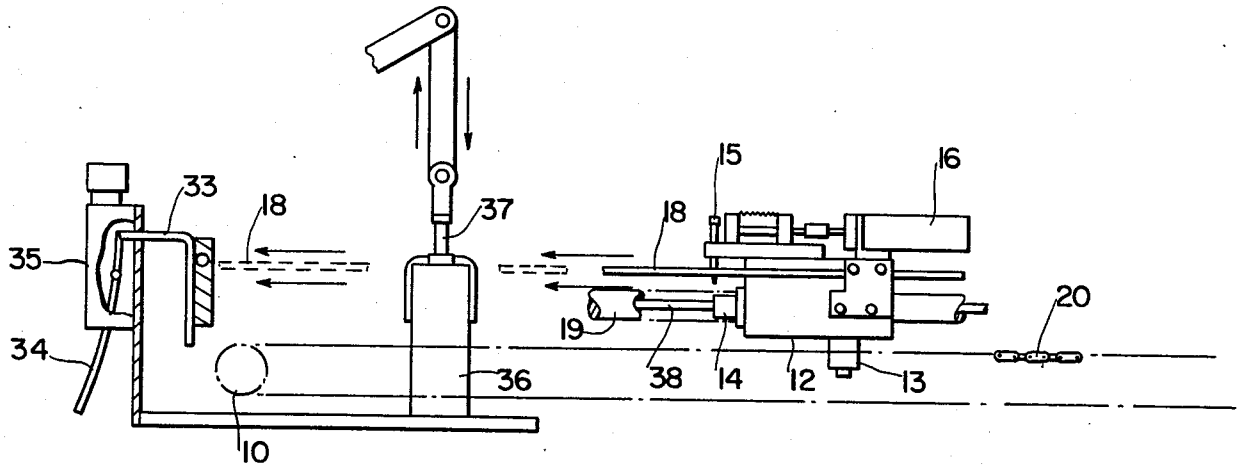
FIG. 9 is a fragmentary side elevation in partial section, illustrating the termination of tube holder assembly movement, as stop rod 18 engages microswitch trip arm 33.

As illustrated in FIGS. 1 and 9, tube holder assembly 12 movement is terminated by stop rod 18 when it is driven forward enough to make contact with microswitch trip arm 33 which engages microswitch arm 34 and opens the electrical circuit, deactivating electrical solenoid 36 and stopping clutch engagement on press head 1, as illustrated in FIG. 9. Manifestly, the movement may be controlled or terminated through suitable electronic sensing devices, (i.e., counters coupled with a proximity switch).

As illustrated in FIG. 2, the vertical length or punching operation stroke of punch 26 is adjusted by ball screw 23, which is locked into position by lock nut 22. Reciprocative vertical movement of press ram 24 projects punch 26 into tube or sheet metal 44 at a constant stroke. Tube 44 is supported by punch arbor 27.

If the opening obtained by the punching operation is required to be smaller, the tube material 44 may be moved downwardly away from the stroke of punch 26 by activating cam 31, illustrated in FIGS. 2 and 4, and allowing tube collar holder 29 to rest upon the low or flat side (flat) of cam 31. Or also adjustment stops 32 for the tube collar holder 29 may be foreshortened to provide a lower stopping surface with respect to the vertical stroke of punch 26.

The activation of cam 31 may be accomplished by means of a rod 18 attached to tube holder assembly 12 making contact on cam arm 30, as the tube holder assembly 12 is indexed forward by the sprocket drive train or by other suitable electronic means, such as conventional counter coupled with a proximity switch, as mentioned above.

The spacing of operations (distance between punching) on tube or sheet metal may be varied by means of adjusting connector shaft 4 in the "T" slot of journal shaft 3 to a more or less eccentric location. This will allow more or less stroke on the connector shaft 4 which catches more or less notches (teeth) on ratchet gear 6. Also, of course, a different size gear may be used.

The tube holder assembly 12 is indexed in a concentric manner to the tube supporting collar 28 by means of linear bearings enclosed in a tube holder assembly 12 mounted on the same center line plane and guided by two longitudinally extending guide bars 19.

Figure 6:
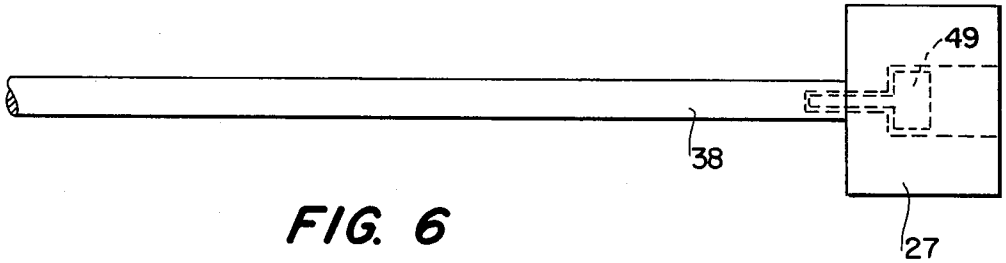
FIG. 6 is a fragmentary side elevation, showing support of one end of the punch arbor support rod 38 within the punch arbor.

Precision orientation of punch 26 with respect to punch arbor 27 and the desired punch or shear clearance is adjusted by means of fine thread nuts 21 connected to punch arbor support rod 38. This is to provide adequate openings for operations performed upon the tubular material. As illustrated in FIG. 6, punch arbor support rod 38 is secured within punch arbor 27 by means of socket head screw 49.

At the end of the punching cycle, the next tube or sheet metal is placed into position after the cylinder connected to brake arm 7 is deactivated, as illustrated in FIG. 8, which releases brake 39 and ratchet arm 5 from the notches in ratched gear 6. This allows free movement of the tube holder assembly 12 to be pushed into position (or moved back) while being limited by back stop 17.

As will be apparent, the present apparatus may utilize a single chain drive system for horizontal moving of the tube, as press ram 24 is actuated vertically downwardly. This system enables the punching of as many as 12 ports per longitudinal inch of tubing, a capability which contrasts with the approximate 8 ports per longitudinal inch in conventional devices. Port size is, of course, controlled by changing the size of the punch. Also, changes in height of the tube collar and vertical stroke length of the punch may be undertaken to vary punch configuration. Manifestly the apparatus may be used for punching holes, extrusions, and lances in sheet metal and tubing without departing from the spirit of the invention.

We claim:

1. Porting apparatus for punching holes in tubing apparatus, comprising:

A. A base;

B. A plurality of punch arbors supported in side-by-side array upon said base, each punch arbor including:

(i) a reciprocably actuated vertical punch; and (ii) a tube collar, aligned with said punch so as to circumferentially engage tubing being punched;

C. A plurality of corresponding tube arbors supported in side-by-side array and movably positioned upon said base away from said tube arbors, so as to engage an end of tubing being punched within said punch arbor, while moving longitudinally with respect to said punch arbor, each said tube arbor further including:

(i) a horizontal guide means concentrically aligning said tube arbor with respect to said tube collar;

(ii) a longitudinally extending guide, limiting longitudinal advance of said tube arbor with respect to said punch arbor; and (iii) a stop means supported upon said horizontal guide as a limit to longitudinal movement of said tube arbor away from said punch arbor; and D. A drive means linked at one end to each of said vertical punches and linked in another portion to each of said tube arbors, so as to move said tube arbors longitudinally, synchronously with reciprocation of said punches.

2. A porting apparatus for punching holes in tubing as in claim 1, said base including a switch actuable upon contact with said stop means, so as to stop vertical reciprocation of said punch and thus longitudinal moving of said tube arbor towards said punch arbor.

3. A porting apparatus for punching holes in tubing as in claim 2, said punch arbor further including a vertical adjusting means adjusting the height of said tube collar and thus a tube being punched with respect to said vertical punch.

4. A porting apparatus for punching holes in tubing as in claim 3, further including punch stroke depth adjusting means, so as to adjust the vertical depth of punch strokes with respect to said tube collar and tubing supported therein.

5. A porting apparatus for punching holes in tubing as in claim 4, said vertical adjusting means including a transversely disposed eccentric cam.

6. A porting apparatus for punching holes in tubing as in claim 5, said vertical adjusting means further including a vertically adjustable set screw interposed between said tube collar and said base.

7. A porting apparatus for punching holes in tubing as in claim 1, including a stop means supported upon said base as a limit to longitudinal movement of said tube arbor with respect to said punch arbor.

8. A porting apparatus for punchig holes in tubing as in claim 1, said punch arbors including a drive shaft with an eccentric cam adusting means interconnecting said shaft and said chain drive, so as to limit longitudinal advance of said chain drive during activation of said punches and, thus, limit longitudinal spacing between punching strokes.

* * * * *